US009922741B2

(12) United States Patent
Labe et al.

(10) Patent No.: US 9,922,741 B2
(45) Date of Patent: Mar. 20, 2018

(54) METHOD FOR THE PRE-CALCINING TREATMENT OF AN AQUEOUS NITRIC SOLUTION COMPRISING AT LEAST ONE RADIONUCLIDE AND OPTIONALLY RUTHENIUM

(75) Inventors: Virginie Labe, Orange (FR); Frédéric Goettmann, Les Angles (FR); Camille Carrignon, Paris (FR); Agnès Grandjean, Saint Marcel de Careiret (FR); Alain Ledoux, Bagnois sur Ceze (FR)

(73) Assignee: Commissariat A L'energie Atomique Et Aux Energies Alternatives, Paris (FR)

( * ) Notice: Subject to any disclaimer, the term of this patent is extended or adjusted under 35 U.S.C. 154(b) by 620 days.

(21) Appl. No.: 13/574,225

(22) PCT Filed: Feb. 15, 2011

(86) PCT No.: PCT/EP2011/052245

§ 371 (c)(1),
(2), (4) Date: Oct. 8, 2012

(87) PCT Pub. No.: WO2011/101358

PCT Pub. Date: Aug. 25, 2011

(65) Prior Publication Data

US 2013/0023713 A1 Jan. 24, 2013

(30) Foreign Application Priority Data

Feb. 17, 2010 (FR) ..... 10 51132

(51) Int. Cl.

| | |
|---|---|
| ***G21F 9/04*** | (2006.01) |
| ***G21F 9/30*** | (2006.01) |
| ***G21F 9/08*** | (2006.01) |
| ***G21F 9/14*** | (2006.01) |

(52) U.S. Cl.

CPC ..... *G21F 9/04* (2013.01); *G21F 9/08* (2013.01); *G21F 9/14* (2013.01); *G21F 9/305* (2013.01)

(58) Field of Classification Search

None

See application file for complete search history.

(56) References Cited

U.S. PATENT DOCUMENTS

| | | | | |
|---|---|---|---|---|
| 3,249,551 | A * | 5/1966 | Bixby | 588/10 |
| 4,943,395 | A | 7/1990 | Sasaki et al. | |
| 5,960,368 | A * | 9/1999 | Pierce | A62D 3/33 210/758 |
| 2004/0265202 | A1* | 12/2004 | Chandran et al. | 423/239.1 |

FOREIGN PATENT DOCUMENTS

| | | | |
|---|---|---|---|
| DK | 619888 | * | 11/1988 |
| JP | 06331793 | * | 5/1993 |
| RU | 2163505 | * | 2/2001 |
| WO | 2005/062314 A1 | | 7/2005 |

OTHER PUBLICATIONS

International Search Report dated May 24, 2011 for International Application No. PCT/EP2011/052245.

* cited by examiner

*Primary Examiner* — Sheng H Davis

(74) *Attorney, Agent, or Firm* — Knobbe Martens Olson & Bear LLP

(57) ABSTRACT

A method for treating before calcination a nitric aqueous solution comprising at least one radionuclide and ruthenium is provided. The method comprises a step for adding to the solution a compound selected from lignins, lignocelluloses, optionally as salts and mixtures thereof.

2 Claims, No Drawings

METHOD FOR THE PRE-CALCINING TREATMENT OF AN AQUEOUS NITRIC SOLUTION COMPRISING AT LEAST ONE RADIONUCLIDE AND OPTIONALLY RUTHENIUM

RELATED APPLICATIONS

This application is a U.S. National Phase of International Application No. PCT/EP2011/052245, filed Feb. 15, 2011, designating the U.S., and published in French as WO 2011/101358 on Aug. 25, 2011 which claims the benefit of French Patent Application No. 10 51132 filed Feb. 17, 2010.

TECHNICAL FIELD

The invention relates to a method for treating a nitric aqueous solution comprising at least one radionuclide and possibly ruthenium before calcination and vitrification.

Such a method notably finds its application in the reprocessing of radioactive active liquid effluents, which may be loaded with ruthenium, which effluents are intended to be conditioned by vitrification.

BACKGROUND

In the field of the nuclear industry, different types of radioactive aqueous liquid effluents are produced during reprocessing, such as:

- aqueous effluents comprising fission products resulting from operations for separating fission products of uranium and of plutonium in the reprocessing of used fuel;
- aqueous effluents comprising dissolution fines and insolubles stemming from shearing and dissolution operations, for example of structural elements and metal sheaths;
- aqueous effluents resulting from operations for rinsing the evaporators.

These aqueous effluents, because of their high radiological activity, cannot be discharged into the environment and are therefore intended to be conditioned so that the radioactive elements and the radioactivity issued from the latter are trapped.

To do this, one of the standard solutions for conditioning this type of effluents, since the early 70s, is vitrification which consists of solidifying said effluents in a glassy matrix, the resulting product thereby forming an ultimate waste suitably conditioned for long-term storage.

In order to facilitate vitrification, the aqueous effluents containing radionuclides are led to being preconcentrated before vitrification as such, so as to remove the water present in these effluents and also denitrate them.

This preconcentration step may be carried out according to one of the following embodiments:

- by distillation of the nitric acid conventionally contained in these aqueous effluents;
- by making an azeotrope with the glycerin followed by distillation;
- by burning the effluents in the presence of a liquid fuel; or
- by calcining said effluents, the latter route being the one presently used in French vitrification operations.

Calcination of liquid effluents comprising radionuclides is achieved conventionally in a calcination reactor, which may for example be an aerosol reactor, a reactor of the rotary drum calciner type or further a reactor with a fluidized bed.

Upon applying the calcination operation, two important problems may occur.

Firstly, certain nitrates, resulting from the action of nitric acid on the chemical elements present in the effluents, as this is the case for sodium nitrate, have a very low melting point which, at the end of the calcination operation, generates a viscous and tacky calcine which may generate clogging of the reactor in which the calcination is carried out. Adding glucose to the effluents, as mentioned in document U.S. Pat. No. 4,943,395, may contribute to promoting denitration and thereby limit partly the aforementioned clogging problem. In order to completely prevent this clogging problem, it may be also necessary to add to the effluents, inorganic adjuvants, such as aluminum nitrate or iron nitrate, which, in order to be effective have to be incorporated at high contents, which may range up to 50% by mass in the final composition of the calcine.

Secondly, the ruthenium potentially present in the radioactive aqueous liquid effluents may be led under the conditions for applying calcinations, to be oxidized into volatile species and to thereby escape into the environment. In order to overcome this problem, certain authors have proposed adding to the solution a reducing agent, in particular glucose, as proposed in the aforementioned document.

As regards calcination of the effluents before vitrification, the following drawbacks emerge from the embodiments of the prior art:

- impossibility for the glucose used as reducing agent, of completely and concomitantly settling the problems related to oxidation of ruthenium and to the viscous and tacky aspect of the calcine at the end of the operation;
- dilution of the radioactive elements to be conditioned, by adding inorganic adjuvants, which have the consequence of increasing the number of produced glass packets and therefore reducing the throughput of the vitrification lines and increasing the cost of storage.

The authors of the present invention thus propose to develop a novel method for treating radioactive nitric aqueous effluents possibly comprising ruthenium, so that during the subsequent calcination, the problems related to the tackiness of the calcine and to the possible formation of volatile ruthenium oxide are solved, without it being necessary to resort to the use of inorganic adjuvants as mentioned above.

DESCRIPTION OF CERTAIN INVENTIVE ASPECTS

The authors of the present invention have surprisingly discovered that by adding to the aforementioned liquid effluents a particular organic adjuvant, it is possible to efficiently solve the whole of the aforementioned problems.

Thus, the invention according to a first object, relates to a method for treating a nitric aqueous solution comprising at least one radionuclide and possibly ruthenium, comprising a step for adding to said solution a compound selected from lignins, lignocelluloses, optionally as salts and mixtures thereof.

By using a compound as mentioned above, one thus has access to a solution which, once calcined, generates a calcine having an excellent denitration level and a better ruthenium level than in the case when glucose was used for treating the solution, and this without it being necessary to add inorganic adjuvants, such as this is the case of certain embodiments of the prior art. Finally, the thereby treated solutions lead to a non-tacky calcine.

Furthermore, the use of lignin and of its derivatives (such as lignosulfonate compounds and lignocellulose compounds) further has the following advantages:

these compounds are abundantly available and at a low costs, because they are by-products of the paper-making industry or further are marketed as a dispersant or retardants for cements;

they thermally cross-link in an acid medium in order to form a very hard product which is involved in the consistency of the calcine and contributes to making the calcine compact and non-tacky.

In the foregoing and in the following, it is specified that, by lignin, is conventionally meant a condensation product comprising units resulting from the polymerization and/or condensation of at least one of the compounds of the following formulae (I), (II) and (III):

(I)

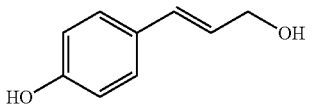

(II)

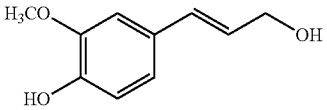

(III)

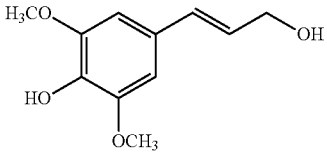

these compounds being also known under the name of cumaryl alcohol, coniferyl alcohol and sinapyl alcohol, respectively.

The lignin includes units originating from the opening of the double bond borne by the aforementioned compounds, at least one of the carbon atoms of this double bond being able to allow binding with another compound via a carbon atom of a double bond or via an atom borne by the phenyl ring (oxygen or carbon) or further being able to be oxidized in order to provide an —OH function which itself may then recombine with another group.

It is thereby possible to find again in the lignins the following simple units:

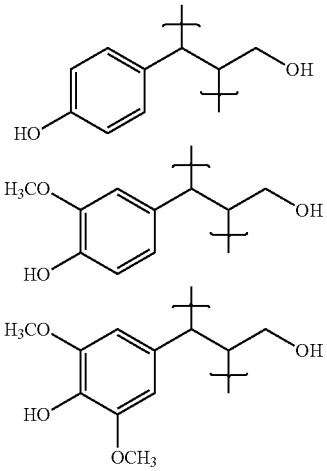

the OH functions may also be involved in the binding with other units, or further more complex units originating from the recombination of certain groups after opening the double bond such as the following unit:

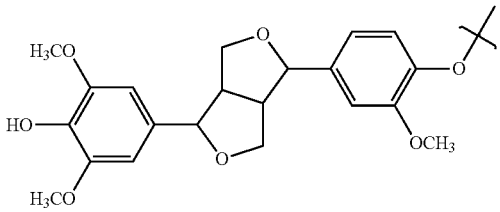

the braces appearing on the aforementioned units indicating the location through which binding is accomplished with other units.

In the foregoing and in the following, by lignocellulose is conventionally meant the combination of the following constituents:

a lignin as defined above;

a cellulose, which is a linear chain resulting from the condensation of D-glucose;

and optionally a hemicellulose, which may consist of a linear or branched chain resulting from the combination of different types of sugars with 5 carbon atoms (such as xylose and arbinose) and of sugars with 6 carbon atoms (such as glucose, galactose and mannose).

In the foregoing and in the following, by radionuclide is conventionally meant a radioactive element, which may for example be a fission element originating from nuclear fuels.

Whether this be for lignins or for lignocelluloses, these compounds may exist as salts, such as for example lignosulfonates.

Lignins and lignocelluloses, optionally as salts, may be used in combination with organic or optionally inorganic additives, the resulting mixture preferably has to have a lignin or lignocellulose content of more than 70% by mass based on the mass of the mixture.

As mentioned above, the thereby treated solution is intended to be subject to calcination, so as to remove the water present in the latter and also denitrate said solution.

Thus, the invention relates to:

a method for calcination of a nitric aqueous solution comprising at least one radionuclide and possibly ruthenium successively comprising:

a) a step for applying the treatment method as defined above;

b) a step for calcining the solution obtained in step a); and a method for vitrification of a nitric aqueous solution comprising at least one radionuclide and possibly ruthenium successively comprising:

c) a step for applying the calcination method as defined above;

d) a step for putting the calcine obtained in step c) in contact with a glass frit;

e) a step for heating the mixture obtained in step d) to an effective temperature in order to obtain melting of the latter;

f) a step for cooling the product obtained in step e) by means of which a glass is obtained.

The calcination step b) mentioned above conventionally consists of suppressing the water present in the solution, this calcination step may be applied by heating to a temperature ranging from 200 to 650° C. This calcination step may be carried out in a rotary oven heated by electric resistors.

With view to vitrification, the calcine is then put into contact with a glass frit which may comprise $SiO_2$ and optionally one or several oxides selected from $B_2O_3$, $Na_2O$, $Al_2O_3$, CaO, $Fe_2O_3$, NiO, CoO, $ZrO_2$ and mixtures thereof.

Before being cooled according to step f), the molten mixture from step e) may be placed in a container with view to storage after cooling.

The cooling step f) is a step which may consist of placing the molten mixture at rest without any heating, for example for at least 24 hours, so that the mixture reaches a temperature below the glass recristallization temperature.

Once it is cooled, when the glass is contained in a container, the latter may be closed with a welded lid, for example by means of an automatic plasma torch.

The invention will now be described with reference to the particular embodiment discussed above as an illustration but not as a limitation.

DETAILED DISCUSSION OF CERTAIN ILLUSTRATIVE EMBODIMENTS

Example

A solution resulting from the dissolution of different oxides in nitric acid was acquired from Kemesys, CD6 Le Verdalai F-13790 Peynier. The table below shows the characteristics of this solution in terms of concentrations.

| Simulating oxides | Concentration (in g/L) |
|---|---|
| BaO | 3.908 |
| $Na_2O$ | 74.13 |
| $Cr_2O_3$ | 0.731 |
| NiO | 0.636 |
| $Fe_2O_3$ | 2.145 |
| $MnO_2$ | 2.114 |
| $La_2O_3$ | 0.576 |
| $Nd_2O_3$ | 4.538 |
| $Ce_2O_3$ | 8.199 |
| $ZrO_2$ | 10.807 |
| $MoO_3$ | 7.503 |
| $P_2O_5$ | 4.581 |
| $RuO_2$ | 5.266 |
| $B_2O_3$ | 8.056 |
| $SO_3$ | 2.121 |

The chemical elements present in the solution were selected as being the most representative of the elements in certain solutions to be vitrified. They are moreover the equivalents of their own radioactive isotopes.

Further, the resulting solution contains 7 mol/L of nitrate ions $NO_3^-$.

For the subsequent discussion, this solution is called a <<model solution>>.

Different tests are conducted:

- a test (a so-called REF test), where 10 mL of the model solution is calcined in a crucible at 400° C. for 20 minutes;
- a test (a so-called A test), where 450 mg of glucose (provided by Sigma Aldrich) is added to 10 mL of the model solution, the resulting solution then being calcined in a crucible at 400° C. for 20 minutes;
- a test (a so-called B test), where 450 mg of lignin (a purified alkaline lignin obtained from Sigma Aldrich) are added to 10 mL of the model solution, the resulting solution then being calcined in a crucible at 400° C. for 20 minutes.

After cooling, it is seen that the calcines of tests A and REF adhere to the bottom of the crucible while the calcine from test B has a granular aspect and is easily extracted from the crucible. By adding lignin, it is thereby possible not to resort to the addition of mineral adjuvants as this would be the case for tests A and REF so that the calcines no longer have the observed tackiness.

In order to evaluate to which extent ruthenium is retained in the calcine, the samples from tests A and B were analyzed by energy dispersion spectroscopy (known under the name of acronym of EDX). To do this, the cerium which is present in the model solution and which is not volatile was used as an internal standard.

The table below indicates the molar ratios (Ru/Ce) obtained for the samples of tests REF, A and B.

| Test | REF | A | B |
|---|---|---|---|
| Molar ratio (Ru/Ce) | 0.34 | 0.49 | 0.64 |

A much greater retention of ruthenium appears for the sample from test B (the initial solution of which was treated with lignin), than for those of the samples from tests A and REF.

In order to evaluate whether the produced calcine may be vitrified, the synthesis of a glass was carried out with the sample from test B, by means of a glass frit, the composition of which appears in the table below.

| Oxide | Mass concentration (in %) |
|---|---|
| $SiO_2$ | 62.85 |
| $B_2O_3$ | 17.12 |
| $Na_2O$ | 7.50 |
| $Al_2O_3$ | 1.00 |
| CaO | 3.87 |
| $Fe_2O_3$ | 3.00 |
| NiO | 0.35 |
| CoO | 0.35 |
| $ZrO_2$ | 1.25 |

11.25 g of glass frit with the composition mentioned above were milled with 7.75 g of calcine from test B. The resulting mixture is heated from room temperature to 500° C. directly and then from 500° C. to 1,100° C. in steps of 100° C. with a 30 minute plateau. After cooling, the obtained glass is visually homogeneous. A cut of the glass was achieved and polished so as to be then analyzed with a scanning electron microscope. A dispersion of small $RuO_2$ particles is observed. The glass is homogeneous in composition. It should also be noted that insofar that the calcine used was obtained without any mineral adjuvants (of the aluminium or iron nitrate type, which may conventionally enter the final composition of the calcine in an amount up to 50% by mass), the incorporation level of simulated radionuclides is twice what it would be with a calcine applying such adjuvants.

What is claimed is:

1. A method for retaining ruthenium within a vitrified product obtained by a vitrification of a nitric acid aqueous solution stemming from a reprocessing of radioactive liquid effluents, the nitric acid aqueous solution comprising radionuclides including ruthenium, the vitrification comprising:

a) calcining the nitric acid aqueous solution to form a calcine;

b) mixing the calcine with a glass frit;

c) heating the mixed calcine and glass frit until a molten mixture is obtained; and d) cooling the molten mixture to form the vitrified product in which the radionuclides including ruthenium are included;

wherein the method comprises, before a), adding to the nitric acid aqueous solution a composition comprising a lignin, a lignocellulose, a salt thereof or a mixture thereof wherein the content of the lignin, the lignocellulose, the salt thereof or mixture thereof is more than 70% by mass based on the mass of the composition.

2. A method for manufacturing a vitrified product by vitrifying a nitric acid aqueous solution stemming from a reprocessing of radioactive liquid effluents, the nitric acid aqueous solution comprising radionuclides including ruthenium; the method successively comprising:

a) adding to the nitric acid aqueous solution a composition comprising a lignin, a lignocellulose, a salt thereof or a mixture thereof wherein the content of the lignin, the lignocellulose, the salt thereof or mixture thereof is more than 70% by mass based on the mass of the composition;

b) calcining the nitric acid aqueous solution, thereby obtaining a non-tacky calcine;

c) mixing the non-tacky calcine with a glass frit;

d) heating the mixed non-tacky calcine and glass frit until a molten mixture is obtained; and e) cooling the molten mixture to form a vitrified product in which the radionuclides including ruthenium are retained.

* * * * *